US005679241A

United States Patent [19]

Stanley et al.

[11] Patent Number: 5,679,241

[45] Date of Patent: Oct. 21, 1997

[54] OLEFIN PLANT RECOVERY SYSTEM EMPLOYING CATALYTIC DISTILLATION

[75] Inventors: Stephen J. Stanley, Matawan; Francis D. McCarthy, Wayne; Charles Sumner, Livingston, all of N.J.; Gary Robert Gildert, Houston, Tex.

[73] Assignees: ABB Lummus Global Inc., Bloomfield, N.J.; Chemical Research & Licensing Company, Pasadena, Tex.

[21] Appl. No.: 442,954

[22] Filed: May 17, 1995

[51] Int. Cl.[6] ..... C10G 7/00

[52] U.S. Cl. ..... 208/92; 208/145; 208/217; 585/253; 585/260; 585/262; 585/264; 585/324; 585/804

[58] Field of Search ..... 585/257, 259, 585/253, 260, 262, 264, 324, 809; 208/92, 145, 217

[56] References Cited

U.S. PATENT DOCUMENTS

| | | | |
|---|---|---|---|
| 3,670,040 | 6/1972 | Davis | 585/259 |
| 3,692,864 | 9/1972 | White et al. | 585/259 |
| 4,020,119 | 4/1977 | Johnson | 585/259 |
| 4,097,370 | 6/1978 | Minkkinen | 208/255 |
| 4,173,529 | 11/1979 | Bauer | 208/255 |
| 4,242,530 | 12/1980 | Smith, Jr. | 585/510 |
| 4,250,052 | 2/1981 | Smith, Jr. | 252/426 |
| 4,404,124 | 9/1983 | Johnson et al. | 252/466 PT |
| 4,443,559 | 4/1984 | Smith, Jr. | 585/259 |
| 4,973,790 | 11/1990 | Deech, Jr. et al. | 585/259 |
| 5,087,780 | 2/1992 | Arganbright | 585/259 |

FOREIGN PATENT DOCUMENTS

| | | |
|---|---|---|
| 0 556 025 A1 | 8/1993 | European Pat. Off. . |
| WO 94/04477 | 3/1994 | WIPO . |

*Primary Examiner*—Helane Myers
*Attorney, Agent, or Firm*—Chilton, Alix & Van Kirk

[57] ABSTRACT

The $C_2$ to $C_5$ and heavier acetylenes and dienes in a thermally cracked feed stream are hydrogenated without significantly hydrogenating the $C_2$ and $C_3$ olefins. Additionally, the $C_4$ and heavier olefins may be hydrogenated. Specifically, the cracked gas feed in an olefin plant is hydrogenated in a distillation reaction column containing a hydrogenation catalyst without the necessity of separating the hydrogen out of the feed and without any significant hydrogenation of the ethylene and propylene. A combined reaction-fractionation step known as catalytic distillation hydrogenation is used to simultaneously carry out the reactions and separations while maintaining the hydrogenation conditions such that the ethylene and propylene remain substantially un-hydrogenated and essentially all of the other $C_2$ and heavier unsaturated hydrocarbons are hydrogenated. Any unreacted hydrogen can be separated by a membrane and then reacted with separated $C_9$ and heavier materials to produce hydrogenated pyrolysis gasoline.

16 Claims, 4 Drawing Sheets

OLEFIN PLANT RECOVERY SYSTEM EMPLOYING CATALYTIC DISTILLATION

BACKGROUND OF THE INVENTION

The present invention relates to a process system for the production of olefins and particularly to processing the charge gas feed to more effectively recover the product and process the by-products.

Ethylene, propylene and other valuable petrochemicals are produced by the thermal cracking of a variety of hydrocarbon feedstocks ranging from ethane to heavy vacuum gas oils. In the thermal cracking of these feedstocks, a wide variety of products are produced ranging from hydrogen to pyrolysis fuel oil. The effluent from the cracking step, commonly called charge gas or cracked gas, is made up of this full range of materials which must then be separated (fractionated) into various product and by-product streams followed by reaction (hydrogenation) of at least some of the unsaturated by-products.

The typical charge gas stream, in addition to the desired products of ethylene and propylene, contains $C_2$ acetylenes, $C_3$ acetylenes and dienes and $C_4$ and heavier acetylenes, dienes and olefins as well as a significant quantity of hydrogen. In the majority of prior processes, the $C_2$ acetylenes and $C_3$ acetylenes and dienes and the $C_5$ and heavier dienes, acetylenes and olefins are catalytically hydrogenated in fixed bed reactors using a series of commercially available catalysts. In a growing number of applications, the $C_4$ acetylenes, dienes, and olefins are also catalytically hydrogenated in fixed bed reactors. These separate hydrogenation steps take place in one of two process sequences. In the first sequence, the charge gas is compressed to between 2.76 and 4.14 MPa (400 and 600 psia). It is then progressively chilled condensing the $C_2$ and heavier components. Hydrogen is cryogenically recovered and methane is fractionated out of the stream. The remaining $C_2$ and heavier stream enters a series of fractionation towers. The first tower produces an overhead stream containing the $C_2$ acetylenes, olefins, and paraffins. This stream is sent to a fixed bed, vapor phase reactor where the $C_2$ acetylene is selectively hydrogenated using the hydrogen cryogenically separated earlier from the charge gas stream.

The second tower in this sequence produces an overhead stream containing the $C_3$ acetylenes, dienes, olefins and paraffins. This stream is sent to a fixed bed, vapor or liquid phase reactor where the $C_3$ acetylenes and dienes are selectively hydrogenated using the hydrogen cryogenically separated earlier from the charge gas stream.

The third tower in this first sequence produces an overhead stream containing the $C_4$ acetylenes, dienes, olefins, and paraffins. This stream is then sent either to battery limits as a final product or to a fixed bed, liquid phase reactor where the dienes, acetylenes, and in some instances the olefins are hydrogenated using the hydrogen cryogenically recovered previously from the charge gas.

The bottoms of the third tower contains the $C_5$ and heavier dienes, acetylenes, olefins and paraffins. This stream is sent to a series of two fixed bed, liquid phase reactors. In the first, the acetylenes and dienes are catalytically hydrogenated. The olefins are catalytically hydrogenated in the second reactor. Both reactors utilize the hydrogen cryogenically recovered previously from the charge gas. In some applications, the third tower produces an overhead stream containing both the $C_4$ and $C_5$ acetylenes, dienes, olefins, and paraffins. These are hydrogenated as discussed previously for the $C_4$'s alone, in a single fixed bed, liquid phase reactor. The $C_6$ and heavier dienes, acetylenes, olefins and paraffins exit in the bottoms of the third tower and are hydrogenated as discussed previously in two fixed bed, liquid phase reactors.

In the second process sequence, the cracked gas is compressed to between 2.07 and 3.45 MPa (300 and 500 psia) and sent to a fractionation tower. The overhead of the tower is the $C_3$ and lighter portion of the charge gas. It is sent to a series of fixed bed, vapor phase reactors where the $C_2$ acetylene and a portion of the $C_3$ acetylenes and dienes are hydrogenated using a small portion (typically less than 10%) of the hydrogen contained in the $C_3$ and lighter stream. The unhydrogenated portion of the $C_3$ acetylenes and dienes as well as the $C_4$ and heavier acetylenes, dienes, and olefins are hydrogenated in a fashion similar to that described above for the first process sequence. This still leaves over 90% of the hydrogen to be recovered cryogenically.

Also in such a system, it is necessary to fractionate out the $C_4$ and heavier materials from the charge gas prior to the hydrogenation step. Otherwise, the heat of the hydrogenation reaction would be excessive and there would be a high rate of hydrogenation catalyst fouling. Since such a fractionation occurs in a high hydrogen and methane environment, the energy requirements are high.

In most prior processes, the $C_2$ and $C_3$ acetylenes and $C_3$ dienes are hydrogenated after the hydrogen separation/recovery step. The hydrogenation of the $C_4$ and heavier acetylenes, dienes, and olefins always occurs after the hydrogen separation step and will consume up to 80% of the total available hydrogen. This hydrogenation also occurs in fixed bed catalytic reactors using catalysts chosen for the selectivity and degree of hydrogen saturation dictated by the particular process.

While widely practiced, both process sequences described above have a number of disadvantages. First, the cracked gas must be chilled and condensed in the presence of hydrogen. Due to the high partial pressure of the hydrogen, the mechanical refrigeration requirements to accomplish the condensation of the $C_2$ and heavier material are high thereby increasing the energy consumption and capital investment in the process. Also, the hydrogen must be cryogenically separated to supply the hydrogen for the various downstream reactors which is both energy and capital intensive. Further, the hydrogenation steps occur in a series of fixed bed reactors requiring between 3 and 6 separate reactor systems thereby increasing the capital investment and complexity of the plant.

SUMMARY OF THE INVENTION

An object of the present invention is to hydrogenate in the liquid phase in a boiling point reactor the $C_2$ to $C_5$ and heavier acetylenes and dienes in a feed stream without hydrogenating the $C_2$ and $C_3$ olefins in the feed stream. Additionally, the $C_4$ and heavier olefins may be hydrogenated still without hydrogenating the $C_2$ and $C_3$ olefins.

More specifically, an object of the present invention is to provide a system and method for hydrogenating the cracked gas in an olefin plant prior to the separation of hydrogen and methane from the cracked gas in a manner so as to hydrogenate the by-products, $C_2$ acetylenes, $C_3$ acetylenes and dienes and $C_4$ and heavier acetylenes and dienes and, if desired, the $C_4$ and heavier olefins, without significant hydrogenation of the ethylene and propylene. More specifically, the invention involves the use of a combined reaction-fractionation step known as catalytic distillation hydrogenation upstream of the chilling and condensation of the $C_2$ and heavier material to simultaneously carry out the reactions and separations in a manner so as to prevent or minimize the hydrogenation of the desired main products and to consume the hydrogen without the need for costly hydrogen separation.

The hydrogenation of the $C_4$ and heavier acetylenes, dienes and olefins increases the hydrogen removal to between 70% and 100% and most typically 90% to 95%. This high removal of hydrogen reduces the hydrogen partial pressure thereby lowering the mechanical refrigeration requirements to chill and condense the $C_2$ and heavier material thereby saving energy and capital investment. The cryogenic separation of the hydrogen from the cracked gas is eliminated. Since all of the hydrogenation reactions occur upstream of the hydrogen-methane separation steps, the hydrogen required for the hydrogenation reactions is already present in the charge gas. The elimination of the cryogenic separation of the hydrogen results in energy saving, lower capital investments and less complexity in the process. In the alternative, the present invention can be employed for hydrogenating the acetylenes and dienes without significant hydrogenation of olefins.

In the two processing sequences currently practiced, fouling in the fractionation towers bottoms typically occurs due to the presence of acetylenes and dienes. The bottoms operating temperatures of these towers are limited to minimize the fouling tendencies but often spare equipment must be provided to ensure continuity of plant operation. Hydrogenating the dienes and acetylenes prior to the fractionation towers eliminates the fouling tendencies in the fractionation tower bottoms.

DESCRIPTION OF THE PREFERRED EMBODIMENTS

Figure 1:
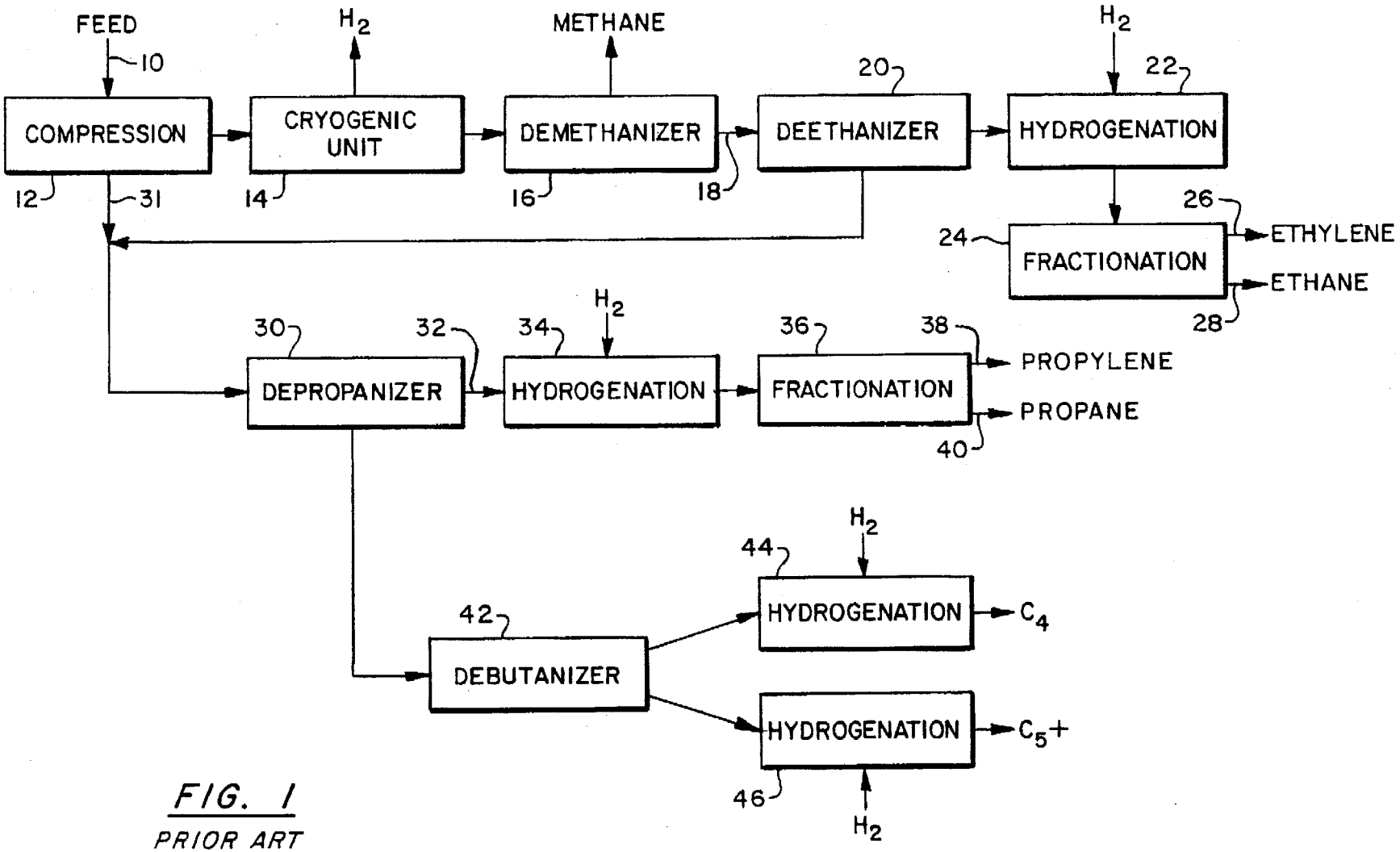
FIG. 1 PRIOR ART
FIG. 1 is a flow sheet for a conventional prior art olefin plant.

Referring first to FIG. 1 which illustrates a conventional prior art olefin plant such as the first process sequence previously discussed, a charge gas 10 is first compressed at 12 up to a pressure of 2.76 to 4.14 MPa (400 to 600 psia). The majority of the compressed gas then undergoes cryogenic treatment at 14 to separate hydrogen followed by separation of methane at 16. A small portion of the $C_3$ and heavier material condenses in the compressor train and often bypasses the cryogenic demethanization and deethanization steps going directly to the depropanizer 30 as stream 31. The gas stream 18 is then deethanized at 20 with the $C_2$ gas stream being hydrogenated at 22 and fractionated at 24 to produce essentially ethylene 26 and ethane 28. The bottoms from the deethanizer 20 are depropanized at 30 with the separated $C_3$ stream 32 being hydrogenated at 34 and fractionated at 36 to produce essentially propylene 38 and propane 40. Likewise, the bottoms from the depropanizer 30 are debutanized at 42 with the $C_4$ stream being hydrogenated at 44 and the $C_5$+ stream being hydrogenated at 46. As can be seen, nearly the entire feed stream is subjected to cryogenic treatment and the separation of hydrogen before any hydrogenations or fractionations are carried out. The separated hydrogen is then used downstream in the hydrogenation units 22, 24, 44 and 46. This scheme with its cryogenic treatment and hydrogen separation has the disadvantages previously discussed.

Figure 2:
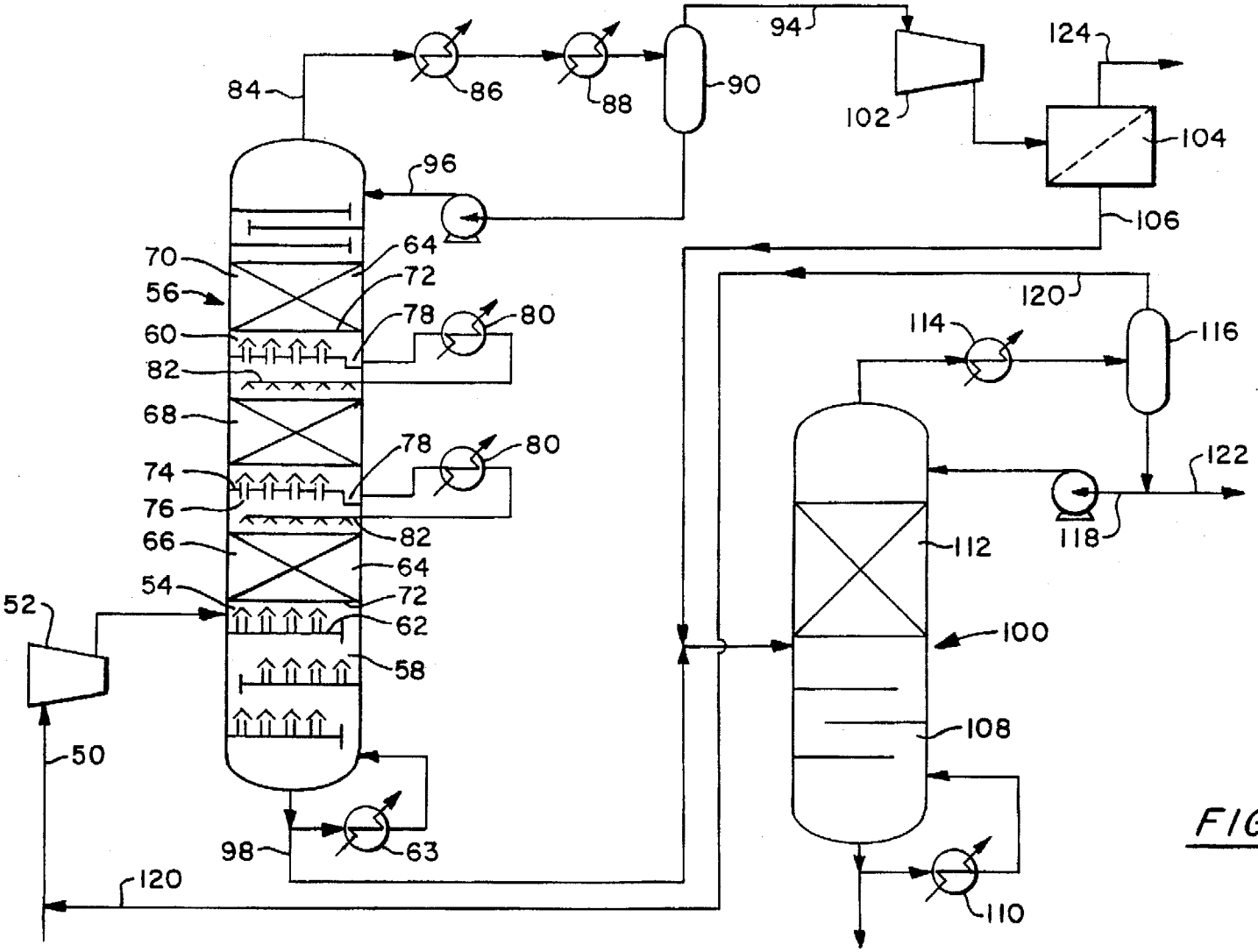
FIG. 2 is a flow sheet for a portion of an olefin plant according to the present invention.

FIG. 2 illustrates the present invention where the charge gas 50 is compressed at 52 but only up to a pressure of 0.69 to 1.72 MPa (100 to 250 psia) and preferably to 1.21 MPa (175 psia). The compressed charge gas stream is fed into the feed zone 54 of a catalytic distillation tower 56. This catalytic distillation tower is a device which simultaneously carries out a Catalytic reaction and distillation and comprises a stripping section 58 below the feed zone 54 and a rectifying/reaction section 60 above the feed zone 54. The stripping section 58 contains any desired distillation internals such as conventional trays 62 illustrated in FIG. 2. Reboiler 63 returns heated bottoms to the column.

The rectifying/reaction section 60 of the column 56 has the dual function of reacting (hydrogenating) selected components of the feed and distilling the components. Therefore, this section contains beds of a conventional hydrogenating catalyst 64. The criteria for this rectifying/reaction section is that conditions be created wherein the unsaturated hydrocarbons, with the exception of ethylene and propylene, are hydrogenated and wherein the requisite distillation is accomplished to separate essentially all of the $C_4$ and lighter material as overhead and essentially all of the $C_6$ and heavier materials as bottoms. A portion of the $C_5$ materials, 20 to 90% and typically 70%, exits the column overhead and the remaining portion, typically 30%, exits the column as bottoms. In some cases, all of the $C_5$ will exit the tower overhead depending upon process, feedstock and byproduct requirements of the individual plants. In order to selectively hydrogenate the $C_2$ acetylenes, the $C_3$ acetylenes and dienes and the $C_4$ and heavier acetylenes, dienes and olefins while leaving the ethylene and propylene un-hydrogenated, the rectifying/reaction section 60 of the column 56 is operated such that there is a substantial concentration gradient of $C_4$ and $C_5$ materials relative to $C_2$ and $C_3$ materials in the liquid phase where the majority of the hydrogenation reaction occurs. In the preferred embodiment, this is accomplished by the use of a high reflux ratio. The high heat of reaction is removed by column reflux which is produced by overhead condensers 86 and 88 and column intercoolers or intercondensers 80.

As shown in FIG. 2, the catalyst is separated into a series of discrete beds 66, 68 and 70. Although three beds are shown, this is only by way of example and could be any number of beds depending on the dynamics of any particular plant. These catalyst beds are retained between the screens or perforated plates 72. Located between the catalyst beds are liquid collecting trays 74 which include vapor flow ports or chimneys 76. The liquid descending from a catalyst bed collects on the respective tray and drains into the sumps 78. The liquid is withdrawn from the sumps 78 as side streams through the intercondenser 80 and is then reinjected back into the column over the next lower catalyst bed through the distribution headers 82. This permits a portion of the heat of reaction to be removed in the intercondensers. By arranging the intercondensers in this fashion, the cooling medium can be cooling water while the cooling medium in the overhead condensers may need to be partly by use of mechanical refrigeration. Hence, the use of the intercondensers can significantly reduce the portion of the heat of reaction which needs to be removed by mechanical refrigeration.

The overhead 84 from the column is cooled in the overhead condenser 86 with cooling water and in the condenser 88 with refrigeration and the resulting vapor and liquid separated at 90. The processing of the collected vapor in line 94 will be discussed hereinafter. The resulting liquid from separator 90 is pumped through line 96 back into the column as reflux. A number of trays are provided to fractionate out ethylene and propylene from the liquid phase preventing these from entering the catalyst beds in high concentrations relative to the $C_4$ and $C_5$ material.

In the present invention, it is imperative to limit the loss of ethylene and propylene in the hydrogenation reaction because these are the principal products of an ethylene or olefin plant. However, under conventional conditions which would permit the hydrogenation of the $C_4$ and heavier olefins, ethylene and propylene losses by hydrogenation would be unacceptably high. That is the primary reason why one of the currently practiced prior art process sequences described earlier only hydrogenates the $C_2$ acetylenes and a portion of the $C_3$ acetylenes and dienes upstream of the chilling and condensing step.

The hydrogenation in the column 56 occurs in the liquid phase. The extent of the reaction is dependant upon the relative reactivity of the various components and the concentration of these components in the liquid phase at any particular point in the column. The $C_2$ and $C_3$ acetylenes and dienes are far more reactive than ethylene and propylene so that they react first and rapidly. However, the relative reactivities of ethylene, propylene and the $C_4$ and heavier olefins, dienes and acetylenes are very close. In order to react a significant quantity of the $C_4$ and heavier olefins, dienes and acetylenes without any significant loss of ethylene and propylene, the concentration of the ethylene and propylene in the liquid phase must be minimized and the concentration and temperature profiles from top to bottom must be controlled. Since the hydrogenation occurs in a fractionation tower, this control can be accomplished by adjusting the overhead (external) reflux produced by the overhead condensers 86 and 88 and the side stream reflux from the intercondensers 80.

The feed 54 to the column at the previously mentioned pressure of 1.25 MPa (0.69 to 1.72 MPa) is in the temperature range of 25° to 120° C. and preferably 70°–90° C. At the feed point, the concentration of the hydrogen is the highest, the temperature (in the rectifying/reaction section) is the highest and the concentration of ethylene and propylene in the liquid phase is the lowest. At this point, the concentration of $C_4$ and $C_5$ components in the liquid phase relative to the concentration of propylene is maintained in the range of 10 to 80 and preferably about 25 while the concentration of $C_4$ and $C_5$ in the liquid phase relative to ethylene is maintained in the range of 30 to 100 and preferably about 80. This low concentration of $C_2$ and $C_3$ in the rectifying/reaction section is achieved by a high overhead reflux ratio and the reflux created by the intercondensers 80. The overhead reflux ratio is in the range of 0.2 to 10 and preferably about 1 to 5 as compared to a reflux ratio of less than 0.2 for a conventional column operated to achieve a similar overhead product specification. At the top of the rectifying/reaction section 60, where the temperature is 38° to 80° C. and preferably 60° C. and where the concentration of hydrogen is low because most of it has reacted, the ratio of $C_4$ and $C_5$ components to $C_2$ and $C_3$ components is similarly high. The overhead reflux ratio and intercondenser temperatures are adjusted to maintain these operating parameters. With the hydrogenation of the $C_2$ acetylenes, the $C_3$ acetylenes and dienes and the $C_4$ acetylenes, dienes and olefins, and a portion of the $C_5$ acetylenes, dienes and olefins, 50 to 90%, typically 70%, of the hydrogen contained in the cracked feed gas is reacted.

The bottoms 98 from the column 56 contain a portion of the $C_5$ material and essentially all of the $C_6$ and heavier material. In the preferred embodiment, this bottoms product is sent to a second catalytic distillation hydrogenation column 100 for the production of hydrogenated pyrolysis gasoline. Alternately, the bottoms product can be burned in the plant fuel system or pumped and sent to a conventional fixed pyrolysis gasoline hydrotreater as previously described under prior art. Also, in the preferred embodiment shown in FIG. 2, the total net overhead 94 from the column 56, containing a portion of the $C_5$ material and essentially all of the $C_4$ and lighter material, is first compressed at 102 and sent to a hydrogen recovery membrane devices 104. Such membrane devices are commercially available for the separation of hydrogen. The intent of the membrane is to recover most of the hydrogen remaining in the overhead stream 94. The resulting hydrogen stream 106 is then fed to the pyrolysis gasoline hydrogenation column 100 along with the bottoms from the column 56. The compression step may or may not be required depending on the specific composition of the cracked gas, hydrogen membrane selection, and operating condition of column 56. Alternately, a conventional fixed bed pyrolysis gasoline hydrotreater could be used without a membrane separator. In this case, the hydrogen now significantly reduced in stream 94 by the hydrogenation reactions occurring in column 56 would be cryogenically recovered as previously discussed.

Pyrolysis gasoline is a complex mixture of hydrocarbons ranging from $C_5$ compounds through materials with a boiling point of about 200° C. The raw feed to the pyrolysis gasoline column 100 is highly unstable due to its high content of diolefins. Therefore, in the production of the pyrolysis gasoline, the feed is hydrogenated in the column 100. The column 100 is similar to the column 56 in that it has a typical bottom stripping section 108, a reboiler 110 and an upper rectifying/reaction section 112 containing the hydrogenation catalyst. It includes an overhead condenser 114 and separator 116 from which reflux 118 is returned to the column. The column may or may not include intercoolers or intercondensers similar to the intercondensers for column 56. In this column 100, the feed of the remaining $C_5$ acetylenes, dienes and olefins and all of the $C_6$ and heavier acetylenes, dienes and olefins is hydrogenated. This column operates between 0.21 and 0.86 MPa and preferably 0.34 MPa. The $C_8$ and lighter materials in the feed enter the catalyst bed where the acetylenes, dienes and olefins are hydrogenated. The $C_9$ and heavier material exits from the bottoms of column 100. The heat of reaction is removed by the reflux stream 118.

The reflux stream 118 also serves to control the selectivity of the hydrogenation reaction. There is a small amount of ethylene in stream 106 and, as has been pointed out, this ethylene is a valuable product and its hydrogenation should be avoided. By the proper control of the column reflux 118, ethylene concentration in the liquid phase in the column can be minimized. This is a technique which is preferable to upgrading the membrane separation process to essentially exclude ethylene from passing through with the hydrogen. The passage of ethylene could be minimized by decreasing the pressure differential across the membrane and/or by increasing the membrane surface area. However, adding membrane surface area is a capital intensive cost and increasing the pressure differential is both energy and capital intensive. The ability to selectively hydrogenate in the column 100 permits a lower capital cost, less energy intensive process. The overhead vapor 120 from the column containing primarily $C_4$ and lighter material is recycled to the feed for the process. The net overhead product condensed liquid is removed at 122 as pyrolysis gasoline.

Figure 3:
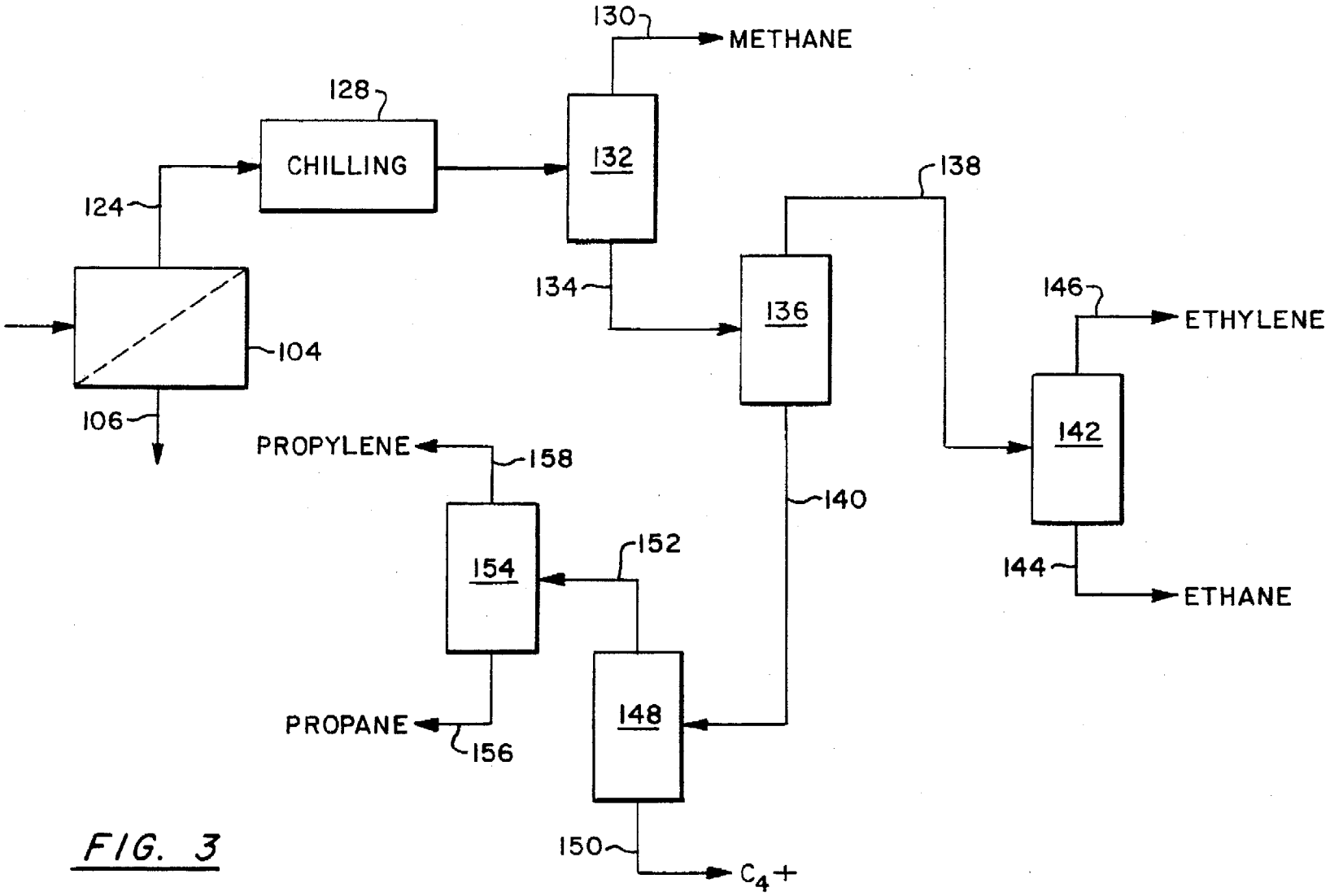
FIG. 3 is a flow sheet for the remaining portion of an olefin plant according to the present invention illustrating the downstream processing of the olefin containing vapors.

FIG. 3 illustrates the processing of the overhead stream 94 after it passes through the hydrogen separation step at 104 and emerges as stream 124. Alternately, this system can be used to process the stream 94 directly in the event that the membrane separation and pyrolysis gasoline portions of the process described above were not used. In that event, additional provisions would be made for cryogenic hydrogen separation.

The vapor stream 124 is chilled at 128 as required to liquify the $C_2$ and heavier components. The methane overhead 130 is then separated in the demethanizer tower 132 from the $C_2$ and heavier bottoms 134. These bottoms 134 are then separated in the deethanizer tower 136 to produce a $C_2$ overhead 138 and a $C_3$ and heavier bottoms 140. The $C_2$ overhead 138, which may first go through a drying step (not shown), is then separated in tower 142 into ethane bottoms 144 and ethylene overhead 146. The bottoms 140 from the deethanizer 136 is then separated in tower 148 into a $C_4$ and heavier bottoms 150 and a $C_3$ overhead 152. This overhead 152, which may also then be dried, is fed to the tower 154 for the separation of propane 156 and propylene 158.

Figure 4:
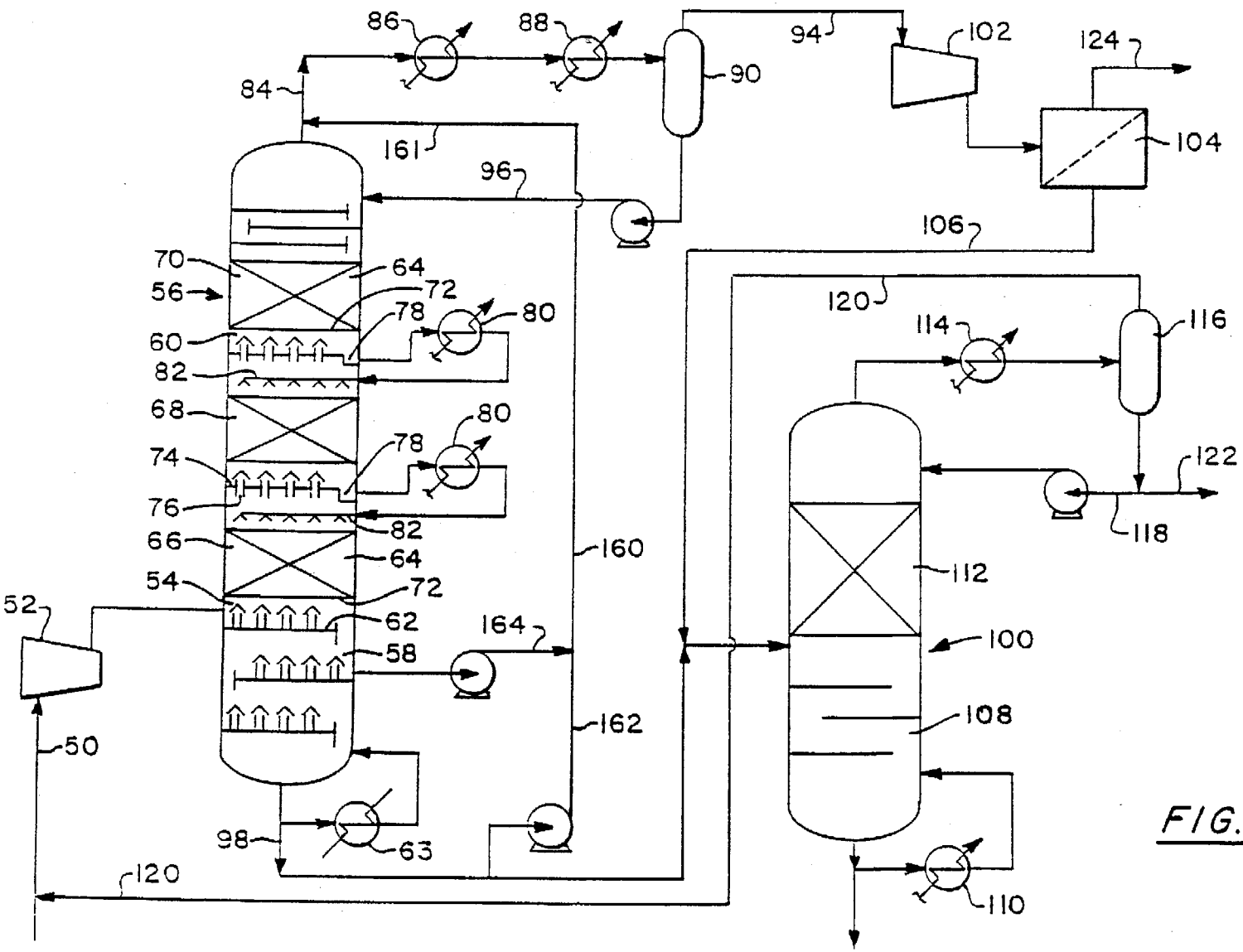
FIG. 4 is a flow sheet similar to the flow sheet of FIG. 2 but illustrating an alternate embodiment of the present invention.

FIG. 4 illustrates an alternate embodiment of the present invention which incorporates recycles from the stripping section 58 of the column 56. In this embodiment, a recycle stream 160 from the stripping section 58 is recycled to the column overhead 84. For example, this recycle may be a portion 162 of the bottoms 98 and/or a portion 164 from within the stripping section. This recycle 164 serves to recycle the heavies, $C_5$+, to the catalytic zone of the column. This increases the amount of dienes and acetylenes and perhaps some olefins which will be hydrogenated, thereby increasing the consumption of hydrogen. Also, it provides another control variable to increase the overhead temperature. This is desirable since it will decrease or eliminate the refrigeration requirements for the reflux. Also, it will provide another variable to control the temperature of the catalytic reaction beds. Although this embodiment achieves distillation internally in the column, it is not classic distillation since there is now some heavies in the overhead. In that case, distillation would be provided downstream to make the final desired separations. The purpose of this embodiment is to improve the control of the reactions taking place in the tower 56 even though that also sacrifices some of the separation by distillation.

The ability of the present invention to remove 85 to almost 100%, typically 90%, of the hydrogen contained in the charge gas prior to chilling and condensation steps lowers the energy consumption and reduces capital costs. By using the hydrogen contained in the charge gas as the source of hydrogen for the various hydrogenation reactions, the need for the separate cryogenic separation of hydrogen is eliminated. By the proper control of the concentration profiles in the catalytic distillation hydrogenation column, the $C_4$ and heavier olefins can be hydrogenated without any significant hydrogenation of either ethylene or propylene. Therefore, the hydrogenation reactions are combined into one or two reactor systems.

We claim:

1. A method of processing a thermally cracked feedstream containing the hydrogen, ethylene, propylene, and other $C_2$, $C_3$, $C_4$, $C_5$, $C_6$ and heavier unsaturated hydrocarbons produced in said thermal cracking to separate said ethylene and propylene from at least some of said other unsaturated hydrocarbons and to hydrogenate at least some of said other unsaturated hydrocarbons with said hydrogen contained in said feedstream without the prior separation of said hydrogen therefrom and without significantly hydrogenating said ethylene and propylene comprising the steps of:

a. introducing said feedstream into the feed zone of a distillation reaction column containing a distillation stripping zone below said feed zone and a combination distillation rectifying and catalytic reaction zone above said feed zone;

b. concurrently:

(i) contacting said feedstream in said distillation reaction column with a vertically oriented bed of hydrogenation catalyst in said combination distillation rectifying and catalytic reaction zone;

(ii) maintaining a high ratio of the total of $C_4$ and $C_5$ hydrocarbons to the total of the $C_2$ and $C_3$ hydrocarbons at the bottom of said vertical oriented bed of hydrogenation catalyst whereby said ethylene and propylene remain essentially unhydrogenated and at least some of said other unsaturated hydrocarbons are hydrogenated;

(iii) fractionating the resulting mixture of hydrogenated and un-hydrogenated products;

c. withdrawing an overhead stream containing essentially all of said $C_2$, $C_3$ and $C_4$ hydrocarbons and a portion of said $C_5$ hydrocarbons and a bottoms stream containing essentially all of said $C_6$ and heavier hydrocarbons and a portion of said $C_5$ hydrocarbons; and d. processing said overhead stream to recover ethylene and propylene.

2. A method of processing as recited in claim 1, wherein said feedstream includes $C_9$ and heavier material and, said step (d) of processing said overhead stream comprises the steps of:

a. separating hydrogen from said overhead stream;

b. feeding said separated hydrogen and said bottoms stream from said distillation reaction column to a pyrolysis gasoline distillation reaction column containing a hydrogenation catalyst;

c. reacting said separated hydrogen with said bottoms stream in said pyrolysis gasoline distillation reaction column to produce a hydrogenated liquid overhead of pyrolysis gasoline and a bottoms of $C_9$ and heavier material.

3. A method of processing as recited in claim 2, wherein said step of separating hydrogen comprises the step of separating hydrogen from said overhead stream through a hydrogen separation membrane.

4. A method of processing as recited in claim 1, wherein said step of maintaining a high ratio includes the step of withdrawing at least one portion of descending liquid as a side stream at a selected point from said bed of hydrogenation catalyst, cooling said side stream and injecting said cooled side stream back into said bed of hydrogenation catalyst.

5. A method of processing as recited in claim 4, wherein said side stream is injected back into said bed at a point below said selected point.

6. A method of processing as recited in claim 1, wherein said hydrogenation reactions occur essentially in the liquid phase in said distillation reaction column.

7. A method of processing as recited in claim 1 wherein said step of maintaining a high ratio includes the step of maintaining a high reflux ratio in said combination distillation rectifying and catalytic reaction zone.

8. A method of processing as recited in claim 7 wherein said reflux ratio is in the range of 0.2 to 10.

9. A method of processing as recited in claim 7 wherein said reflux ratio is in the range of 1 to 5.

10. A method for treating a thermally cracked feedstream containing the hydrogen, methane, ethylene, propylene, acetylene, methyl acetylene, propadiene and other $C_4$ and $C_5$ and heavier unsaturated hydrocarbons produced in said thermal cracking to separate said ethylene and propylene, to saturate at least a portion of said acetylene, methyl acetylene, propadiene and $C_4$ and $C_5$ and heavier unsaturated hydrocarbons and to consume a portion of the hydrogen contained in said feedstream without the prior separation of said hydrogen therefrom and comprising the steps of:

a. introducing said feedstream to a first distillation reaction column and concurrently (i) selectively hydrogenating at least a portion of said acetylene, methyl acetylene, propadiene and $C_4$ and $C_5$ and heavier unsaturated hydrocarbons while maintaining a high ratio of the total of the $C_4$ and $C_5$ hydrocarbons to the total of the $C_2$ and $C_3$ hydrocarbons in said first distillation column and without any substantial hydrogenation of said ethylene and propylene; and (ii) separating by fractional distillation said $C_4$ and lighter hydrocarbons from said $C_5$ and heavier hydrocarbons;

b. removing substantially all of said hydrogen and $C_4$ and lighter hydrocarbons as overheads and substantially all of said $C_5$ and heavier hydrocarbons as bottoms from said distillation reaction column;

c. separating said hydrogen from said $C_4$ and lighter hydrocarbons in said overheads; and d. processing said overheads less said hydrogen to recover ethylene and propylene.

11. A method as recited in claim 10, wherein said step (d) of processing said overheads less said hydrogen comprises the steps of:

a. feeding the overheads less said hydrogen to a demethanizer distillation column wherein methane is separated as overheads from the $C_2$ and heavier hydrocarbons which are taken as bottoms;

b. feeding the bottoms from the demethanizer to a deethanizer distillation column where the $C_2$ hydrocarbons are separated as overheads from the $C_3$ and heavier hydrocarbons which are taken as bottoms;

c. feeding the overheads from the deethanizer to an ethylene/ethane distillation column where the ethylene is taken as overheads and the ethane is recovered as bottoms;

d. feeding the bottoms from the deethanizer to a depropanizer distillation column where the $C_3$ hydrocarbons are separated as overheads from the $C_4$ hydrocarbons which are taken as bottoms; and e. feeding the overheads from the depropanizer to a propylene/propane distillation column where the propylene is taken as overheads and the propane is recovered as bottoms.

12. A method for treating a thermally cracked feedstream containing the hydrogen, methane, ethylene, propylene, acetylene, methyl acetylene, propadiene and other $C_4$ and heavier unsaturated hydrocarbons produced in said thermal cracking to separate said ethylene and propylene, saturate a portion of the other unsaturates and consume a portion of the hydrogen without the prior separation of said hydrogen therefrom and comprising the steps of:

a. introducing said feedstream to a distillation reaction column and concurrently (i) selectively hydrogenating at least a portion of the acetylene, methyl acetylene, propadiene and $C_4$ and heavier unsaturated hydrocarbons while maintaining a high ratio of the total of the $C_4$ and $C_5$ hydrocarbons to the total of the $C_2$ and $C_3$ hydrocarbons in said first distillation column and without substantially hydrogenating said ethylene and propylene and (ii) separate by fractional distillation the $C_4$ and lighter hydrocarbons from the remainder of the hydrocarbons;

b. removing substantially all of the hydrogen and $C_4$ and lighter hydrocarbons as overheads and all of the $C_5$ and heavier hydrocarbons as bottoms from said distillation reaction column;

c. separating the hydrogen from the $C_4$ and lighter hydrocarbons in said overheads;

d. feeding the overheads less said hydrogen to a demethanizer distillation column wherein methane is separated as overheads from the $C_2$ and heavier hydrocarbons which are taken as bottoms;

e. feeding the bottoms from the demethanizer to a deethanizer distillation column where the $C_2$ hydrocarbons are separated as overheads from the $C_3$ and heavier hydrocarbons which are taken as bottoms;

f. feeding the overheads from the deethanizer to an ethylene/ethane distillation column where the ethylene is taken as overheads and the ethane is recovered as bottoms;

g. feeding the bottoms from the deethanizer to a depropanizer distillation column where the $C_3$ hydrocarbons are separated as overheads from the $C_4$ hydrocarbons which are taken as bottoms; and h. feeding the overheads from the depropanizer to a propylene/propane distillation column where the propylene is taken as overheads and the propane is recovered as bottoms.

13. The method according to claim 12, wherein hydrogen is separated in step (c) through a hydrogen separation membrane.

14. In a combined process for treating a thermally cracked feedstream containing hydrogen, methane, ethylene, propylene, acetylene, methyl acetylene, propadiene and $C_4$ and heavier acetylenes, dienes and olefins produced in said thermal cracking to separate the ethylene and propylene and saturate a portion of the other unsaturates with said hydrogen contained in said feedstream without the prior separation of said hydrogen therefrom and without significantly hydrogenating said ethylene and propylene, the improvement comprising consuming a portion of the hydrogen by the steps of:

introducing said feedstream to a distillation reaction column to concurrently (i) selectively hydrogenate a portion of the acetylene, methyl acetylene, propadiene and $C_4$ and heavier acetylenes, dienes and olefins while maintaining a high ratio of the $C_4$ and heavier hydrocarbons to the $C_2$ and $C_3$ hydrocarbons and (ii) separate by fractional distillation the $C_4$ and lighter hydrocarbons from the remainder of the hydrocarbons.

15. A method of processing a thermally cracked feedstream containing hydrogen, ethylene, propylene, and other $C_2$, $C_3$, $C_4$ and heavier unsaturated hydrocarbons, to hydrogenate at least some of said unsaturated hydrocarbons with said hydrogen contained in said feedstream without hydrogenating said ethylene and propylene comprising the steps of:

a. introducing said feedstream into the feed zone of a distillation reaction column containing a distillation stripping zone below said feed zone and a combination distillation rectifying and catalytic reaction zone above said feed zone;

b. concurrently (i) contacting said feedstream in said distillation reaction column with a vertically oriented bed of hydrogenation catalyst in said combination distillation rectifying and catalytic reaction zone;

(ii) maintaining hydrogenation conditions within said bed of hydrogenation catalyst including a high ratio of the $C_4$ and heavier hydrocarbons to the $C_2$ and $C_3$ hydrocarbons whereby said ethylene and propylene remain essentially un-hydrogenated and essentially all of said other $C_2$, $C_3$, and $C_4$ and heavier unsaturated hydrocarbons are hydrogenated;

(iii) fractionating the resulting mixture of hydrogenated and un-hydrogenated products;

(iv) recycling heavy materials from the stripping zone to the top of the enriching zone or to the top of the catalytic reaction zone or both in order to increase the temperatures in these zones and to provide additional unsaturates to be hydrogenated;

c. withdrawing an overhead stream containing essentially all of the said $C_2$, $C_3$, and $C_4$ hydrocarbons and a portion of the heavier hydrocarbons and a bottoms stream containing the remaining portion of the heavier hydrocarbons; and d. processing said overhead stream to recover ethylene and propylene.

16. A method of processing a thermally cracked charge gas containing the hydrogen, ethylene, propylene, and other $C_2$, $C_3$, $C_4$ and heavier unsaturated hydrocarbons produced in said thermal cracking to separate said ethylene and propylene from at least some of said other unsaturated hydrocarbons and to hydrogenate at least some of said other unsaturated hydrocarbons with said hydrogen contained in said charge gas without the prior separation of said hydrogen therefrom and without significantly hydrogenating said ethylene and propylene comprising the steps of:

a. introducing said charge gas into the feed zone of a distillation reaction column containing a distillation stripping zone below said feed zone and a combination distillation rectifying and catalytic reaction zone above said feed zone;

b. concurrently:

(i) contacting said charge gas in said distillation reaction column with a vertically oriented bed of hydrogenation catalyst in said combination distillation rectifying and catalytic reaction zone;

(ii) maintaining a high ratio of the total of $C_4$ and heavier hydrocarbons to the total of the $C_2$ and $C_3$ hydrocarbons at the bottom of said vertical oriented bed of hydrogenation catalyst whereby said ethylene and propylene remain essentially un-hydrogenated and at least some of said other unsaturated hydrocarbons are hydrogenated;

(iii) fractionating the resulting mixture of hydrogenated and un-hydrogenated products;

c. withdrawing an overhead stream containing essentially all of said $C_2$, $C_3$ and $C_4$ hydrocarbons and a portion of said heavier hydrocarbons and a bottoms stream containing essentially all of the remaining heavier hydrocarbons; and d. processing said overhead stream to recover ethylene and propylene.

* * * * *